United States Patent [19]

Hatch et al.

[11] 4,001,541

[45] Jan. 4, 1977

[54] FLASH FUSING SYSTEM WITH ENERGY CONTROL

[75] Inventors: Gilbert J. Hatch, Walworth, N.Y.; Richard C. Johnson, Pasedena, Calif.; Ihor Kulbida, Fairport, N.Y.

[73] Assignee: Xerox Corporation, Stamford, Conn.

[22] Filed: June 11, 1975

[21] Appl. No.: 585,944

[52] U.S. Cl. ..... 219/216; 219/501; 219/502; 250/317; 250/319; 315/158; 350/96 B

[51] Int. Cl.[2] ..... G03G 15/20

[58] Field of Search ..... 219/216, 388, 502; 355/3 FU, 9, 1; 350/96 B; 250/316–319, 214 R, 219; 315/158

[56] References Cited

UNITED STATES PATENTS

| | | | |
|---|---|---|---|
| 3,445,626 | 5/1969 | Michaels | 219/502 X |
| 3,501,635 | 3/1970 | Sprunger | 250/319 |
| 3,871,761 | 3/1975 | Mabrouk | 219/216 X |

*Primary Examiner*—C. L. Albritton

[57] ABSTRACT

A flash fusing system for fusing toner images onto support material in which the support material is transported in a path past one or more flash fusing lamps. The flash fusing lamps are coupled to a circuit including a power supply voltage which is adjusted by an input from a sensing circuit including, a photodiode which measures the density of the unfused toner images on support material and converts the information into electrical signals. The electrical signals are supplied to an integrator which in turn is coupled to the power supply voltage of the circuit for energizing the flash lamps.

5 Claims, 5 Drawing Figures

FLASH FUSING SYSTEM WITH ENERGY CONTROL

The invention relates generally to a xerographic flash fusing system and in particular to an improved flash fusing system with energy control from toner images to be fused onto flexible support materials produced by copier/duplicator systems. More specifically this invention relates to a xerographic flash fusing apparatus and method for rapidly and efficiently producing uniform toner image fixing on a flat support material based on image reflectivity therefrom.

In the xerographic process used for copier/duplicator systems, a plate, generally comprising a conductive backing upon which is placed a photoconductive insulating surface, is uniformly charged and the photoconductive surface then exposed to a light image of an original to be reproduced. The photoconductive surface is caused to become conductive under the influence of the light image so as to selectively dissipate the electrostatic charge found thereon to produce what is developed by means of a variety of pigmented resin materials specifically made for this purpose which are known in the xerographic art as "toners". The toner material is electrostatically attracted to the latent image areas on the plate in proportion to the charge concentration found thereon. Areas of high charge concentration become areas of high toner density while correspondingly low charge image areas become proportionally less dense. The developed image is transferred to a final support material, typically paper, and fixed thereto to form a permanent record or copy of the original.

Many forms of image fixing techniques are known in the prior art, the most prevalent of which are vapor fixing, heat fixing, pressure fixing or combinations thereof as described in U.S. Pat. No. 3,539,161. Each of these techniques, by itself or in combination suffer from deficiencies which make their use impractical or difficult for specific xerographic applications. In general, it has been difficult to construct an entirely satisfactory heat fuser having a short warm up time, high efficiency, and each of control. A further problem associated with heat fusers has been their tendency to burn or scorch the support material. Pressure fixing method whether hot or cold have created problems with image offsetting, resolution, degradation and producing consistently a good class of fix. On the other hand, vapor fixing, which typically employs a toxic solvent has proven commercially unfeasible because of the health hazard involved. Equipment to sufficiently isolate the fuser from the surrounding ambient air must by its very nature be complex and costly.

With the advent of new materials and new xerographic processing techniques, it is now feasible to construct automatic xerographic reproducing apparatus capable of producing copies at an extremely rapid rate. Radiant flash fusing is one practical method of image fixing that will lend itself readily to use in a high speed automatic processor as described in U.S. Pat. No. 3,529,129. The main advantage of the flash fuser over the other known methods is that the energy, which is propagated in the form of electromagnetic waves, is instantaneously available and requires no intervening medium for its propagation. As can be seen, such apparatus does not require long warm up periods nor does the energy have to be transferred through a relatively slow conductive or convective heat transfer mechanism.

Although an extremely rapid transfer of energy between the source and the receiving body is afforded by the flash fusing process, a major problem with flash fusing as applied to the xerographic fixing art, has been designing apparatus which can operate at one power level adequate to fuse all possible copy prints under varying conditions. This has led to several problems including a vast over consumption of power and poor negative latitude.

With the present invention the density of unfused toner images on an individual copy sheet is sensed via its reflectivity which is used to regulate the power supply of the flash fusing system.

It is therefore an object of this invention to improve flash fusing of xerographic toner images on support material.

Another object of the invention is to accomplish flash fusing of electrostatic images at a reduced power consumption.

Another object of the invention is to enable highly efficient fusing of toner images onto flexible support material using the reflectivity of the images to be fused as a control thereof.

For a better understanding of the invention as well as other objects and further features thereof, reference is had to the following description of the invention to be read in conjunction with the drawings wherein.

Figure 1:
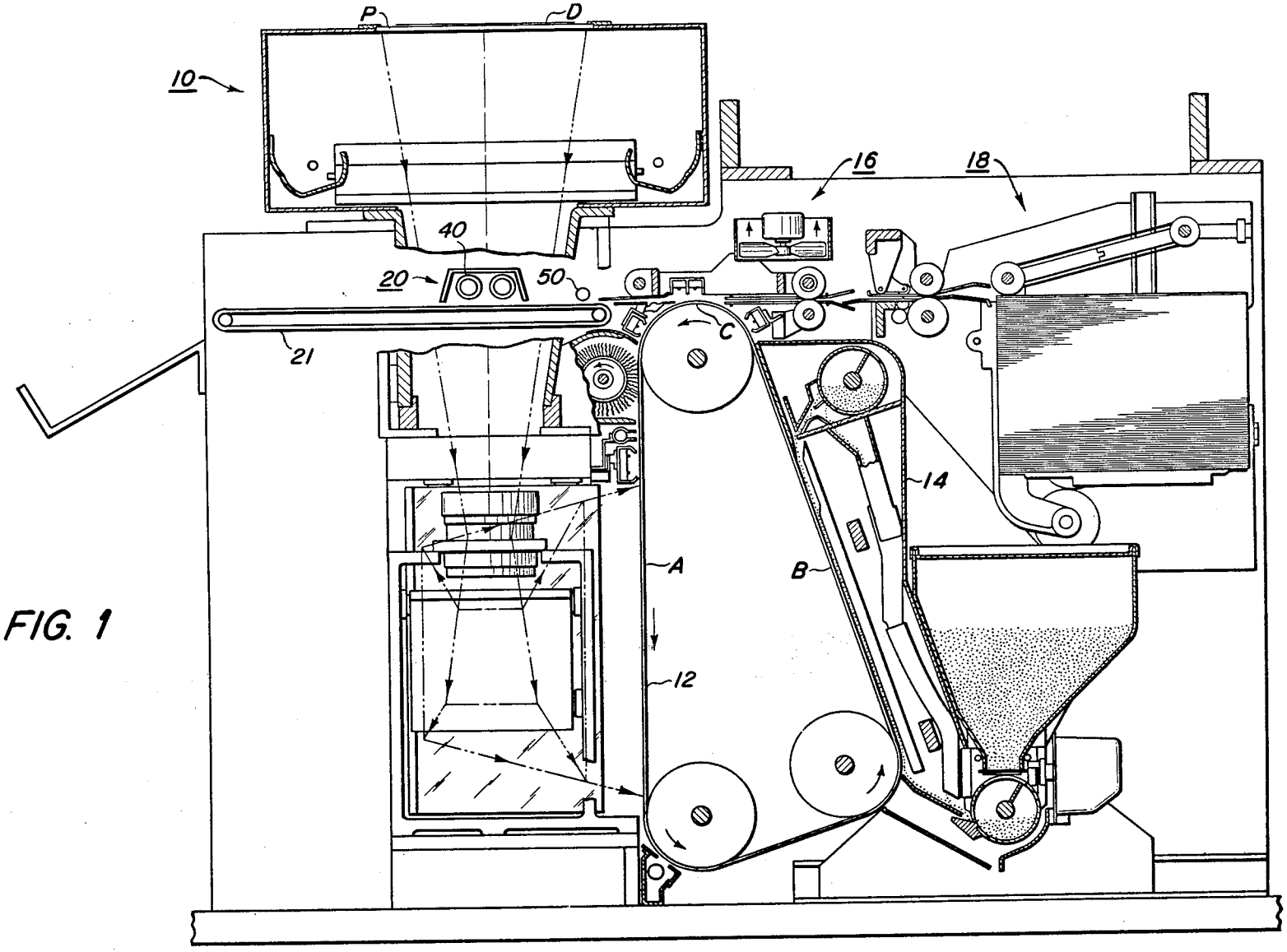
FIG. 1 illustrates xerographic reproducing apparatus incorporating a flash fusing system in accordance with the invention.

For a general understanding of the illustrated copier/reproduction machine, in which the invention may be incorporated, reference is had to FIG. 1 in which the various system components for the machine are schematically illustrated. As in all electrostatic systems such as a xerographic machine of the type illustrated, a light image of a document to be reproduced is projected onto the sensitized surface of a xerographic plate to form an electrostatic latent image thereon. Thereafter, the latent image is developed with an oppositely charged developing material to form a xerographic powder image, corresponding to the latent image on the plate surface. The powder image is then electrostatically transferred to a support surface to which it is fused in this case by an improved flash fusing system whereby the powder images are caused permanently to be affixed to the support surface as will be described more fully hereinafter.

In the illustrated machine, an original D to be copied is placed upon a transparent support platen P fixedly arranged in an illumination assembly generally indicated by the reference numeral 10, arranged at the left end of the machine. The image rays are projected by means of an optical system for exposing the photosensitive surface of a xerographic plate in the form of a flexible photoconductive belt 12 which can be any suitable xerographic material such as selenium on an insulating surface.

The photoconductive belt 12 is mounted upon the frame of the machine and is adapted to move in the direction of the arrow at a constant rate. During this movement of the belt, the light image of the original on the platen is flashed upon the xerographic surface of the belt. The flash exposure of the belt surface to the light image discharges the photoconductive layer in the areas struck by light, whereby there remains on the belt a latent electrostatic image in image configuration corresponding to the light image projected from the original on the supporting platen. As the belt surface continues its movement, the electrostatic image passes through a developing station B in which there is positioned a developer assembly generally indicated by the reference numeral 14. The developer assembly 14 deposits developing material to the upper part of the belt 11 where the material is directed to cascade down over the upwardly moving inclined belt in order to provide development of the electrostatic image. As the developing material is cascaded over the xerographic plate toner particles in the development material are deposited on the belt surface to form powder images.

The developed electrostatic image is transported by the belt to a transfer station C where sheet of copy paper is moved at a speed in synchronism with the moving belt in order to accomplish transfer of the developed image. There is provided at this station a sheet transport mechanism generally indicated at 16 adapted to transport sheets of paper from a paper handling mechanism generally indicated by the reference numeral 18 to the developed image on the belt at the station C.

After the sheet is stripped from the belt 12, it is conveyed to an improved flash fuser system generally indicated by the reference numeral 20 where the developed and transferred xerographic powder image on the sheet material is permanently affixed thereto according to the present invention as will be explained hereinafter. After fusing, the finished copy is discharged from the apparatus by a belt conveyor 21 to a suitable point for collection externally of the apparatus.

Suitable drive means may be arranged to drive the selenium belt 12 in conjunction with timed flash exposure of an original to be copied, to effect conveying and cascade of toner material, to separate and feed sheets of paper and to transport the same across the transfer station C and to convey the sheet of paper through the flash fuser in timed sequence to produce copies of the original.

It is believed that the foregoing description is sufficient for the purpose of this application to show the general operation of an electrostatic copier using an illumination system constructed in accordance with the invention. For further details concerning the specific construction of the electrostatic copier, reference is made to U.S. Pat. No. 3,661,452 issued May 9, 1972 in the name of Hewes et al.

Figure 2:
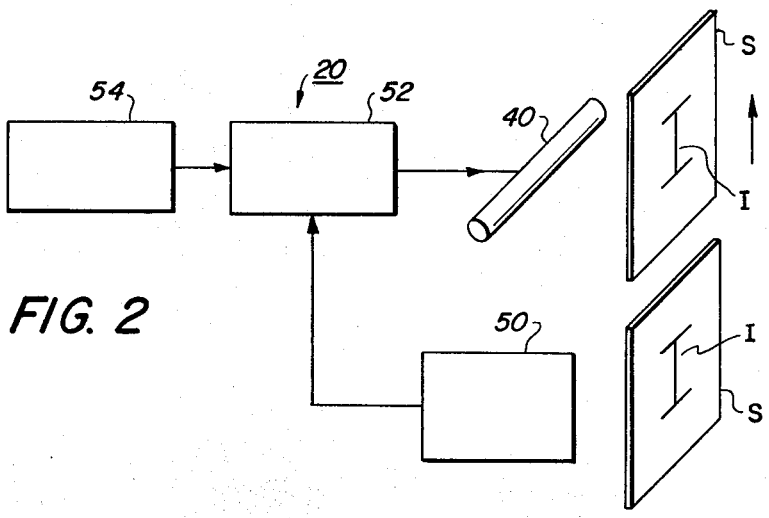
FIG. 2 is a block diagram of the flash fusing system of the invention.

In accordance with the present invention as best depicted in the block diagram of FIG. 2, the mass of toner images I on individual copy sheets S is sensed via its reflectivity and an input produced by sensor and signal conditioner 50 is made to energy storage power supply 52 which supplies an input to flash lamps 40 of the system 20 to produce the desired power level at optimum energy for flashing the lamps. Power supply 52 receives another input from D.C. voltage sources 54.

Figure 3:
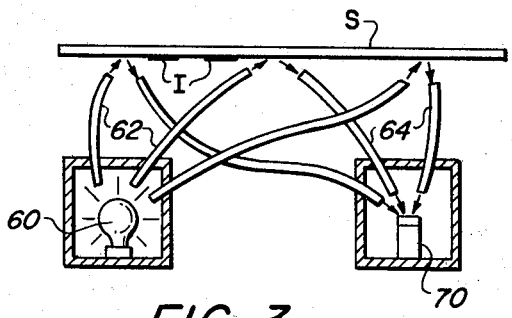
FIG. 3 is a schematic view of the copy reflectivity sensing apparatus.

Referring now to FIG. 3 there is shown the sensing apparatus for sensing the density of toner on a copy sheet to be fused and producing spatially concentrated optical signals and converting the optical signals into electrical signals proportional thereto for input as will be described more fully hereinafter. As the lead edge of the copy sheet S bearing loose toner images I comes into view of the sensing apparatus light originating from a light source 60 is conducted towards the copy sheet S via an array of fiber optic elements 62 such that a uniform line source of illumination is provided across the sheet S. A second array of fiber optic elements 64 receives the reflected illumination which is transmitted to a localized area 65 and coupled into a photosensor 70.

Figure 4:
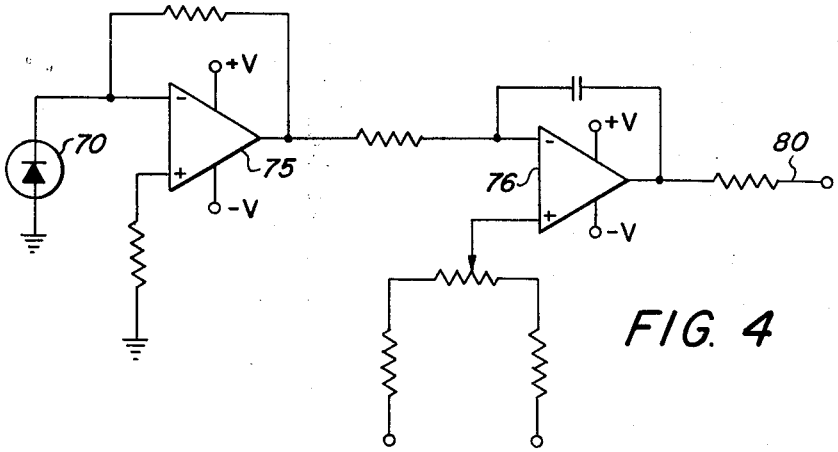
FIG. 4 is a circuit for the sensor and signal conditioner shown by a block in FIG. 2.

Shown in FIG. 4 is a circuit for the signal sensor and signal conditioner 50. Photosensor 70 is a photodiode whose current is proportional to the incident illumination. The output of photosensor 70 is amplified by amplifier 75 and integrated by integrator 76 providing an output voltage 80 for controlling the output of the energy storage power supply 52. It should be understood that the output voltage 80 from integrator 76 must be reset after each copy sheet S is fused by any suitable circuit.

Figure 5:
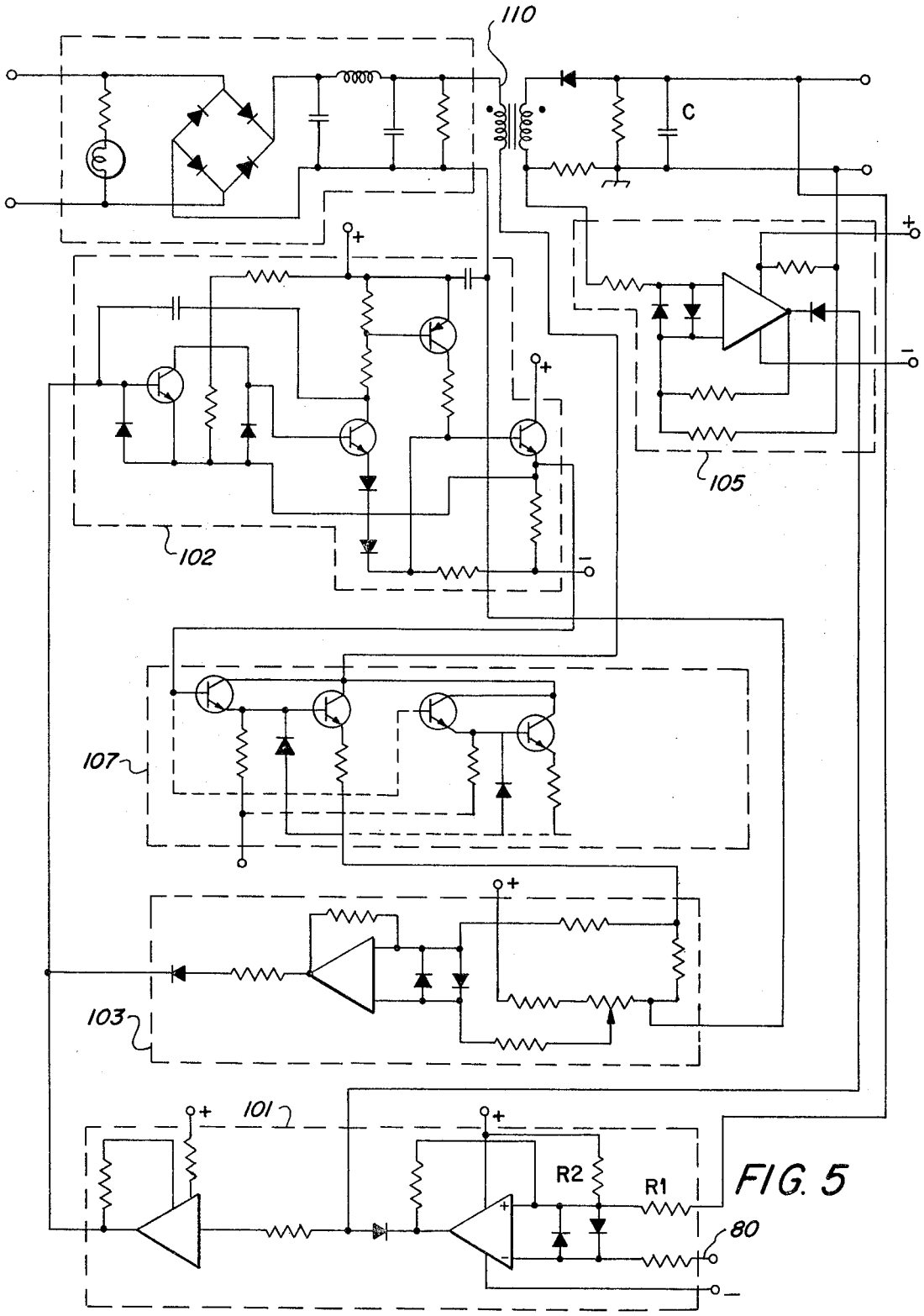
FIG. 5 is a circuit for the energy storage power supply shown by a block in FIG. 2.

The operation of the system can be best understood by referring to the diagramatic circuit shown in FIG. 5. The output 80 from sensor and conditioner 50 is fed into voltage sensor 101 which inhibits transistor switch driver 102. The transistor switch driver 102 is also inhibited by an input from the minimum current sensor 105. The peak current sensor 103 provides an enable voltage to driver 102. The driver 102 provides base-drive to transistor switches 107 which switches current through the primary winding of transformer 110. The phasing of primary with respect to the secondary is such that when the primary is conducting the secondary is not conducting and vice versa. The energy from the primary winding is coupled to the secondary winding when said switch is turned off. The secndary energy is rectified and stored in capacitor C. Discharging the capacitor which reduces the load impedance of the secondary to virtually zero allows the primary to conduct in the normal manner since the primary is not coupled to the secondary load when said switch is on. The voltage of capacitor C is sensed by and divided down by resistors R1 and R2 and inputed into voltage sensor 101. The energy stored on capacitor C is delivered as the input voltage to flash lamps 40 for fusing the image I on the copy sheets S. This input voltage supplied to the flash fusing lamps 40 results in optimum energy to fuse the toner images onto the copy sheets.

Above is described a new and improved flash fusing system which is an improvement over conventional flash exposure systems. It will be appreciated that the fusing system of the invention requires no quenching tube to terminate the flash. With the present invention a control system is provided requiring simpler and much less sophisticated circuitry and a greater inherent reliability.

While the invention has been described with reference to the structure disclosed herein it is not confined to the details set forth in this application but is intended to cover such modifications or charges as may come with the purpose of the improvements or the scope of the following claims;

What is claimed is:

1. An improved flash fusing system for fusing toner images onto support material comprising:

flash lamp means, means for advancing support material bearing loose toner images along a path past said flash lamp means;

a power supply means coupled to said flash lamp means including a transformer means having a secondary winding coupled to a chargeable capacitor means for energizing said flash lamp means and means for sensing the energy on said capacitor means; and sensing means for sensing the density of toner images on the copy sheets advanced and producing signals directly proportional to the total reflectivity of the toner images and transmitting said signals to the power supply means for controlling the charge on said capacitor means to a predetermined level.

2. A system according to claim 1 wherein said flash lamp means includes a plurality of flash lamps.

3. A system according to claim 1 including means for comparing the charge of said capacitor means with signals produced by said sensing means.

4. A system according to claim 1 wherein said power supply means includes switching means for controlling current through a primary winding of said transformer means.

5. A system according to claim 4 wherein the current through said primary winding and switching means is sensed and transmitted to a switch driver means connected to said switching means.

* * * * *